US011988057B2

(12) United States Patent
Borg

(10) Patent No.: US 11,988,057 B2
(45) Date of Patent: May 21, 2024

(54) DOWNHOLE WIRELINE TOOL STRING

(71) Applicant: WELLTEC A/S, Allerød (DK)

(72) Inventor: Peder Løkke Borg, Allerød (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 17/582,383

(22) Filed: Jan. 24, 2022

(65) Prior Publication Data

US 2022/0275708 A1 Sep. 1, 2022

(30) Foreign Application Priority Data

Jan. 25, 2021 (EP) ..... 21153349

(51) Int. Cl.

| | |
|---|---|
| ***E21B 29/00*** | (2006.01) |
| ***E21B 4/04*** | (2006.01) |
| ***E21B 10/43*** | (2006.01) |
| ***E21B 23/00*** | (2006.01) |
| ***E21B 23/01*** | (2006.01) |
| ***E21B 37/00*** | (2006.01) |
| ***E21B 41/00*** | (2006.01) |

(52) U.S. Cl.

CPC ..... *E21B 29/002* (2013.01); *E21B 4/04* (2013.01); *E21B 10/43* (2013.01); *E21B 23/001* (2020.05); *E21B 23/01* (2013.01); *E21B 37/00* (2013.01); *E21B 41/00* (2013.01)

(58) Field of Classification Search

CPC ..... E21B 10/43; E21B 23/001; E21B 23/01; E21B 29/002; E21B 37/00; E21B 4/04; E21B 41/00

See application file for complete search history.

(56) References Cited

U.S. PATENT DOCUMENTS 2,328,494 A * 8/1943 Reaney ..... B23C 5/2468 407/34
3,110,084 A 11/1963 Kinzbach
3,726,351 A * 4/1973 Williams, Jr. ..... E21B 10/54 407/53

(Continued)

FOREIGN PATENT DOCUMENTS

WO 2015/010014 3/2015

OTHER PUBLICATIONS

Extended Search Report for EP21153349.2, dated Jul. 9, 2021, 8 pages.

*Primary Examiner* — Daniel P Stephenson
(74) *Attorney, Agent, or Firm* — Nixon & Vanderhye P.C.

(57) ABSTRACT

A downhole wireline tool string has an electric motor powered through a wireline for providing rotational output, a tool section for anchoring the downhole wireline tool string inside a well tubular metal structure, an operational tool rotated by the rotational output and defining the front end and an end surface arranged axially opposite the wireline and having an annular wall with a circumference and a wall thickness defined by an inner wall radius and an outer wall radius from the centre tool axis. The operational tool comprises a first grinding section having an inner face being arranged at a first distance from the centre tool axis, the first distance being smaller than the inner wall radius, and a second grinding section having an outer face being arranged at a second distance from the centre tool axis, the second distance being greater than the outer wall radius.

15 Claims, 4 Drawing Sheets

(56) References Cited

U.S. PATENT DOCUMENTS

Figure 1:
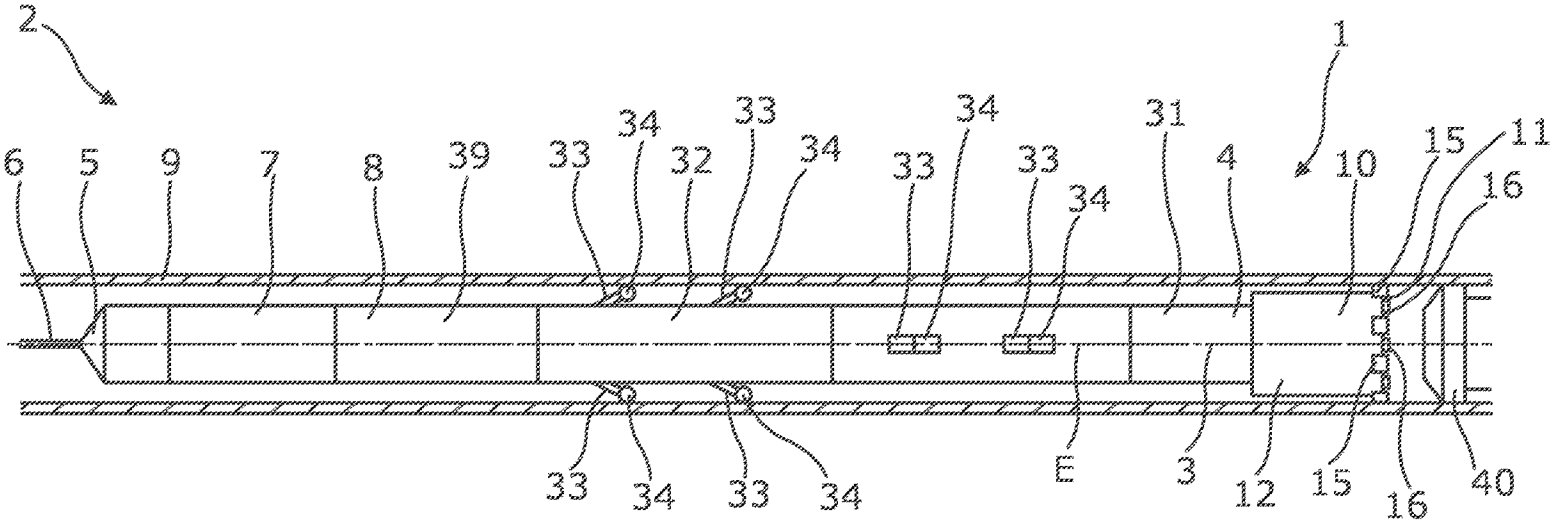

| | | | | | |
|---|---|---|---|---|---|
| 4,274,769 | A * | 6/1981 | Multakh | E21B 10/48 | D15/139 |
| 4,440,247 | A * | 4/1984 | Sartor | E21B 10/602 | 175/387 |
| 4,966,502 | A * | 10/1990 | Magyari | B28D 1/041 | 408/59 |
| 5,038,859 | A | 8/1991 | Lynde et al. | | |
| 5,137,098 | A * | 8/1992 | Raffaelli | B24D 7/18 | 407/54 |
| 5,626,189 | A * | 5/1997 | Hutchinson | E21B 29/00 | 166/55.6 |
| 6,070,665 | A * | 6/2000 | Singleton | E21B 23/02 | 166/50 |
| 10,702,975 | B2 * | 7/2020 | Pearce | C22C 49/00 | |
| 2017/0159385 | A1 | 6/2017 | Krüger et al. | | |
| 2022/0275708 | A1 * | 9/2022 | Borg | E21B 4/04 | |

* cited by examiner

DOWNHOLE WIRELINE TOOL STRING

This application claims priority to EP Patent Application No. 21153349.2 filed 25 Jan. 2021, the entire contents of which is hereby incorporated by reference.

The present invention relates to a downhole wireline tool string for removing material of a component in a well downhole by an annular grinding area, the downhole wireline tool string having an axial extension and a centre tool axis, a front end and a top end connectable to a wireline.

A casing or a liner in a well often has components such as a valve or a plug, and over the years such safety valve, ball valve or flapper valve may get stuck in its closed position closing the well, e.g. due to accumulating scale, and then needs to be removed. Plugs such as bridge plugs or torque plugs may also need to be removed after some time, but may also become stuck and thus cannot be pulled in the intended way. When removing a plug some elements of the plug are in a radially extended position compared to other elements of the plug, and in order to remove the plug by machining when pulling is not possible, and the area to be removed for releasing the plug has to have a large radial thickness.

Restrictions may normally be removed by means of a wireline tool, which is quickly run into the well, but the power available downhole to perform the operation is very limited, and when such large area needs to be removed in order to remove the plug, coiled tubing or similar powered tools are necessary.

It is an object of the present invention to wholly or partly overcome the above disadvantages and drawbacks of the prior art. More specifically, it is an object to provide an improved wireline-powered tool string capable of removing plugs downhole.

The above objects, together with numerous other objects, advantages and features, which will become evident from the below description, are accomplished by a solution in accordance with the present invention by a downhole wireline tool string for removing material of a component in a well downhole by an annular grinding area, the downhole wireline tool string having an axial extension and a centre tool axis, a front end and a top end connectable to a wireline, comprising:

- an electric motor powered through the wireline for providing rotational output,
- a tool section for anchoring the downhole wireline tool string inside a well tubular metal structure, and
- an operational tool rotated by the rotational output and defining the front end and an end surface arranged axially opposite the wireline and comprising an annular wall having a circumference and a wall thickness defined by an inner wall radius and an outer wall radius from the centre tool axis, wherein the operational tool comprises at least a first grinding section and a second grinding section arranged at the end surface, the first grinding section having an inner face being arranged at a first distance from the centre tool axis, the first distance being smaller than the inner wall radius, and the second grinding section having an outer face being arranged at a second distance from the centre tool axis, the second distance being greater than the outer wall radius.

Furthermore, an outer face of the first grinding section may be arranged at a fourth distance from the centre tool axis, where the fourth distance is smaller than the second distance.

Moreover, an inner face of second grinding section may be arranged at a fifth distance from the centre tool axis, where the fifth distance is larger than the first distance.

By having the fourth distance being smaller than the second distance and/or the fifth distance may be larger than the first distance, the contact area between the grinding sections and the material to be grinded and removed is reduced and the friction generated during rotation is thus correspondingly reduced and the power required to provide the rotation is likewise reduced. When performing a machining operation on wireline, the power available in the tool several kilometres down the well is substantially reduced compared to drill pipe and coiled tubing operations, and therefore such reduction makes it possible to increase the grinding area and thus remove a larger area on a component.

Moreover, the first grinding section and the second grinding section may be separate elements.

Furthermore, the first and second grinding sections may be one grinding element.

Also, the operational tool may comprise a plurality of first grinding sections and a plurality of second grinding sections, the first and second grinding sections being arranged in turns, i.e. a first grinding section may be arranged next to a first second grinding section, which may be arranged next to a second first grinding section.

In addition, the first grinding section may be arranged at a third distance from the second grinding section along the circumference of the annular wall, the grinding sections having a circumferential length, and the third distance being smaller than the circumferential length, preferably the third distance being 20% smaller than the circumferential length, more preferably the third distance being 40% smaller than the circumferential length.

Further, the annular grinding area may be defined as the area between the first distance and the second distance when rotating the operational tool in one turn around the centre tool axis, the annular grinding area being greater than the cross-sectional area of the annular wall at the end surface.

Moreover, when viewing the front end towards the top end, the first and the second grinding sections may have a projected grinding section area perpendicular to the axial extension.

The annular grinding area to be removed may be defined as the annular grinding area between the first distance and the second distance when rotating the operational tool in one turn around the centre tool axis, and the annular grinding area is greater than the projected grinding section area being the common area of all grinding sections.

Furthermore, the projected grinding section area may be smaller than the cross-sectional area of the annular wall at the end surface perpendicular to the centre tool axis.

Also, the projected grinding section area may be smaller than the annular grinding area, preferably 10% smaller than the annular grinding area, more preferably 25% smaller than the annular grinding area, and even more preferably 50% smaller than the annular grinding area.

In addition, the first and second grinding sections may form a monolithic whole.

Further, the inner wall radius may be at least 3 times larger than a radial thickness of the annular grinding area, and preferably 5 times larger than a radial thickness of the annular grinding area.

Furthermore, the wall thickness may have a centre wall axis when seen in cross-section perpendicular to the axial extension, the first grinding section and the second grinding section overlapping along the centre wall axis.

In addition, the centre wall axis may be circular. Thus, the centre wall axis being a centre wall circular axis.

Also, the wall thickness may have a centre wall axis when seen in cross-section perpendicular to the axial extension, the first grinding section and the second grinding section overlapping along the centre wall axis and thus along the circumference of the annular wall.

In addition, the operational tool may further comprise a fastening element, the annular wall being rotatable around the fastening element.

Further, the fastening element may comprise a base part and a projecting part, the projecting part being more flexible than the base part.

Moreover, the downhole wireline tool string may further comprise a gear unit arranged between the electric motor and the operational tool so that the operational tool is rotated at a higher rotational speed than the rotational output of the electric motor.

Furthermore, the tool section may comprise a driving unit having projectable arms, each arm having a wheel, wherein the wheels contact the inner surface of the well tubular metal structure for propelling the driving unit and the tool string forward in the casing.

Also, the tool section may comprise an anchoring unit having anchoring elements projected from the tool string for contacting the inner surface of the well tubular metal structure for anchoring the tool string inside the well tubular metal structure.

In addition, the tool section may comprise a stroking unit for providing an axial stroke of at least the operational tool along the centre tool axis.

Further, the downhole wireline tool string may comprise a pumping unit.

Moreover, the operational tool may remove material in a component in the well, such as a plug or a valve.

Furthermore, the grinding section(s) may thus be an insert(s) and may be embedded particles of tungsten carbide, cubic boron nitride (CBN) and/or diamonds, which particles are embedded in a binder material. In this manner, the grinding sections/inserts may be worn while still being able to machine as new particles will appear, which particles are configured to proceed with the machining.

Further, the grinding sections may be abrasive sections.

Moreover, the grinding section(s) may be fastened directly to the face of the annular wall without any support/backing, such as a steel support.

Furthermore, the particles may have a grain size of 0.1-1.0 mm.

Additionally, the particles may be distributed in the binder material throughout the length, the width and the height of the inserts.

Thus, the grinding section(s) may be solid inserts of particles distributed in the binder material.

In addition, the annular wall having the circumference and end surface at which the grinding sections are arranged.

Furthermore, the grinding section(s) may at least partly extend from the end face of the annular wall away from the wireline substantially along the centre tool axis.

Moreover, the grinding section(s) may extend at a distance from the end face of the annular wall away from the wireline substantially along the centre tool axis.

Additionally, the distance at which the grinding section(s) may extend from the end face of the annular wall is at least 5% of the total length of the grinding section(s), preferably at least 10% of the total length of the grinding section(s).

Further, each grinding section(s) may be an insert forming a monolithic whole.

In addition, the annular wall having a plurality of grooves, and in each groove a grinding section is at least partly arranged.

Also, the plurality of grooves in the annular wall are distributed along the inner wall radius and the outer wall radius.

Moreover, the plurality of grooves in the annular wall does not extend across the wall thickness.

Furthermore, at least one of the plurality of grooves may extend in the inner face of the annular wall and at least another of the plurality of grooves may extend in the outer face of the annular wall.

Also, the plurality of grooves in the annular wall may have a bottom in the annular wall.

In addition, the plurality of grooves in the annular wall may extend along the centre axis.

Furthermore, the grinding section(s) may be welded to the annular wall.

In this way, forming each grinding section as a monolithic whole, e.g. as abrasive sections, welding the grinding sections to the annular wall and/or arranging the grinding sections in the grooves make the manufacturing process very simple while creating a robust operational tool.

Figure 2:
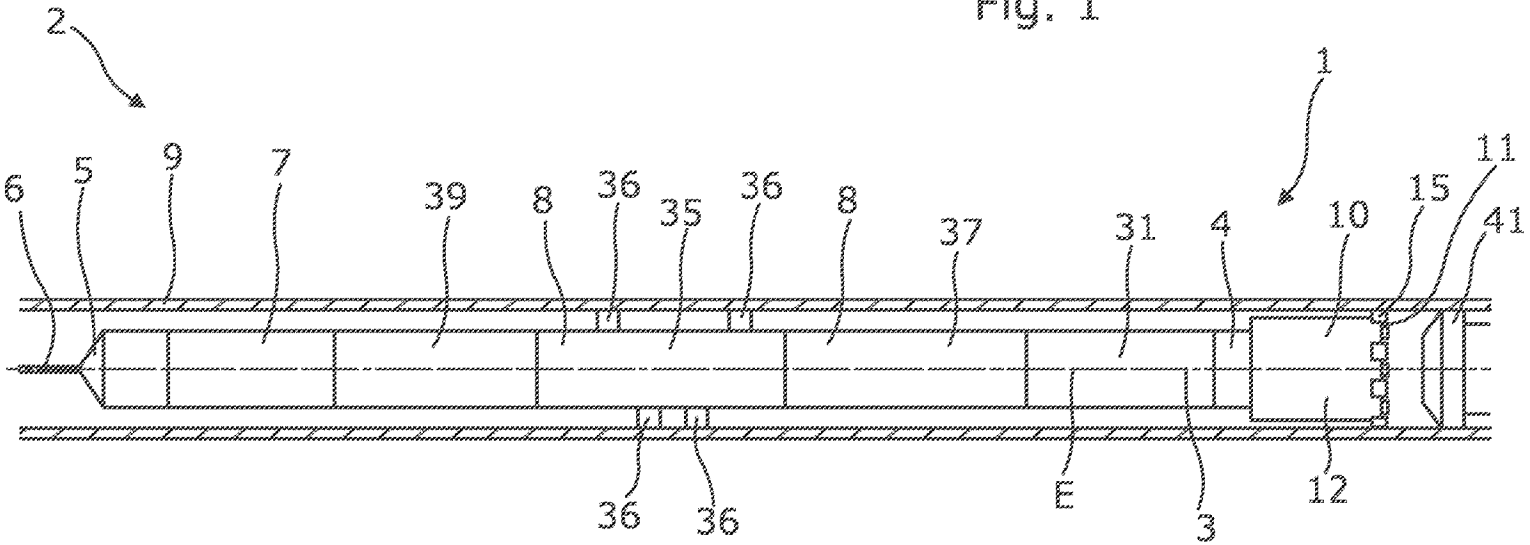
Figure 4:
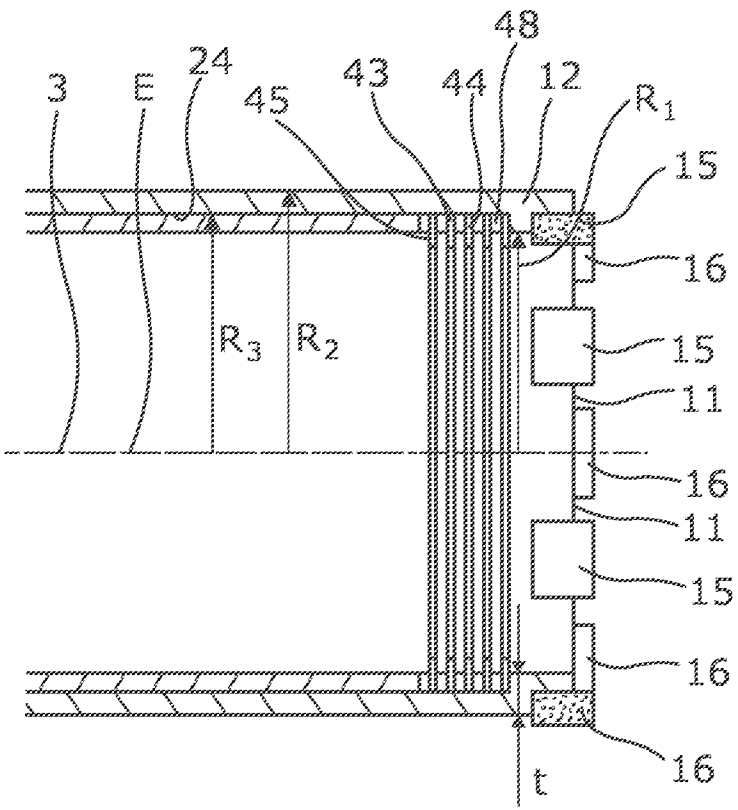
Figure 3:
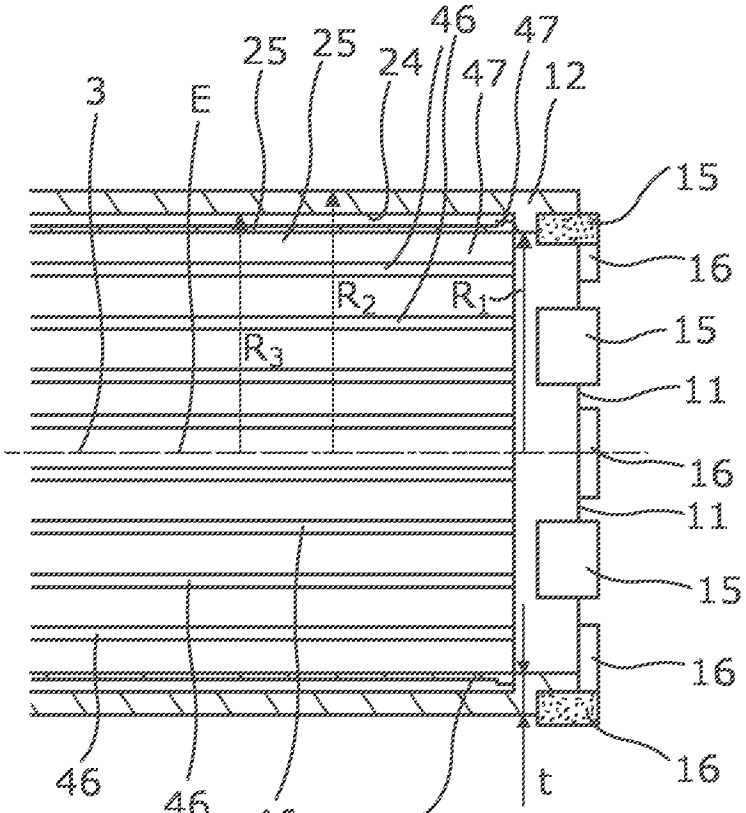
Figure 5:
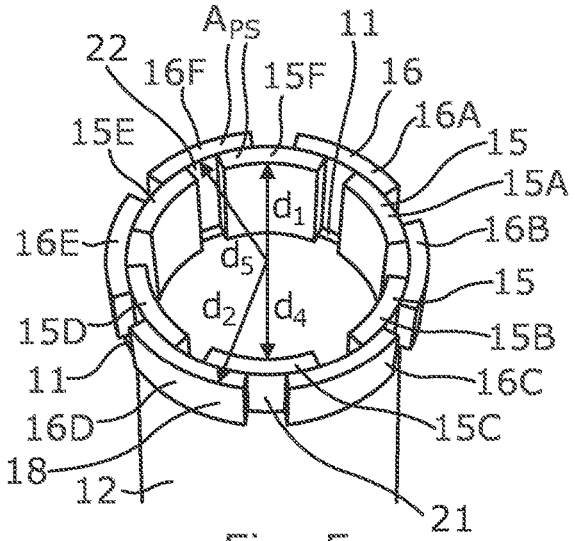
Figure 6:
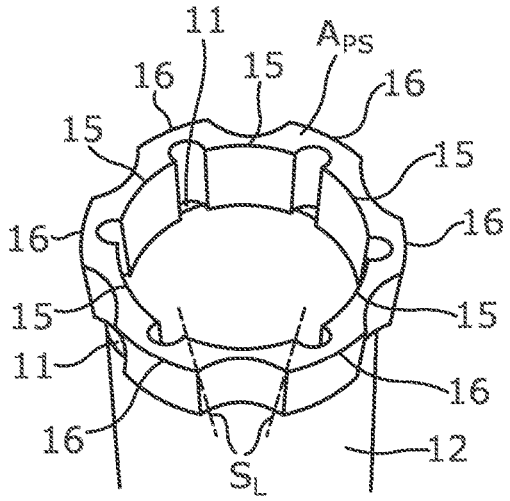
Figure 7:
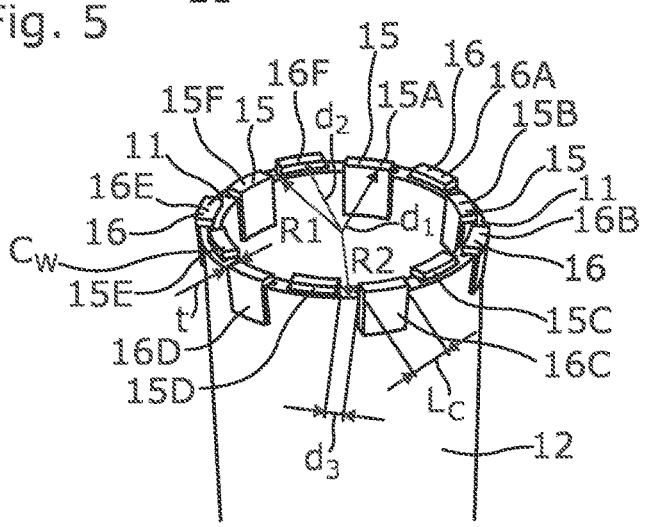
Figure 9:
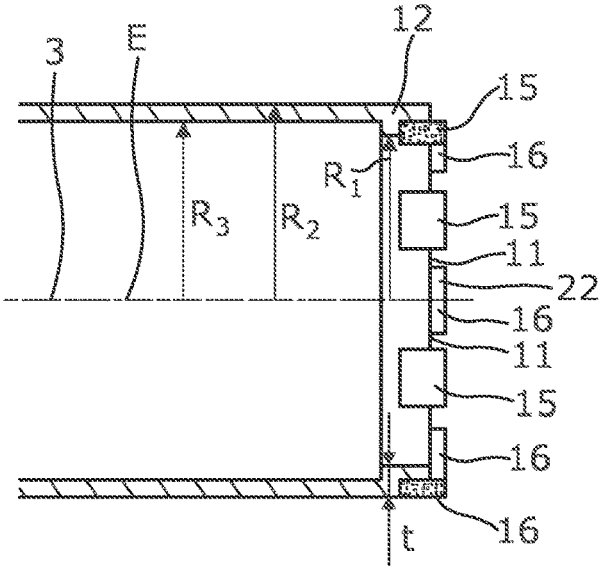
Figure 11:
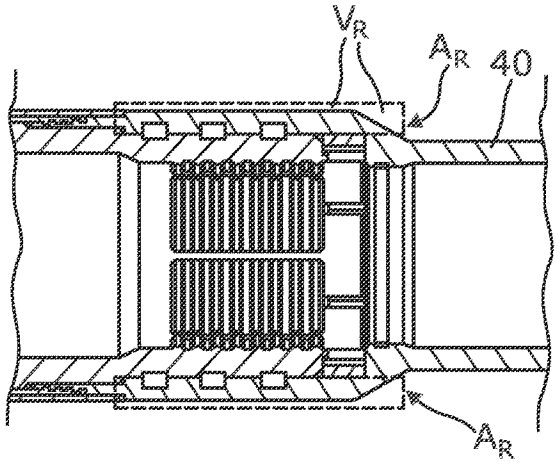
Figure 10:
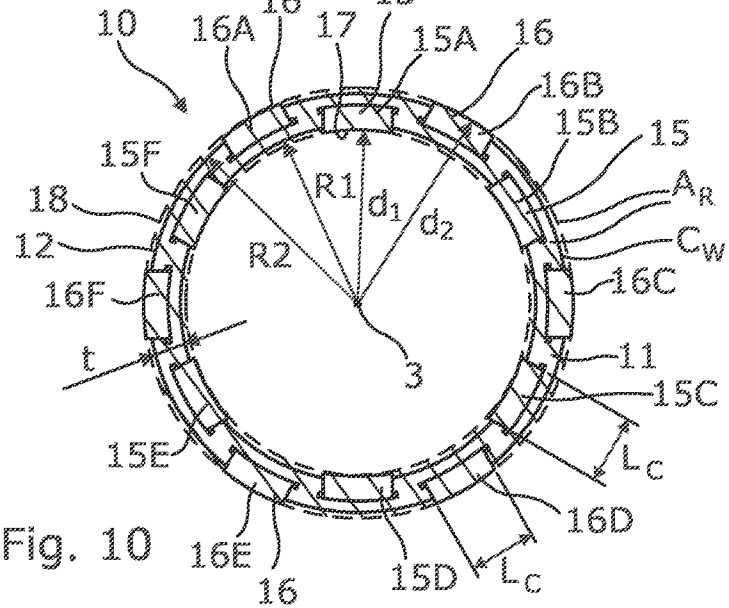
Figure 8:
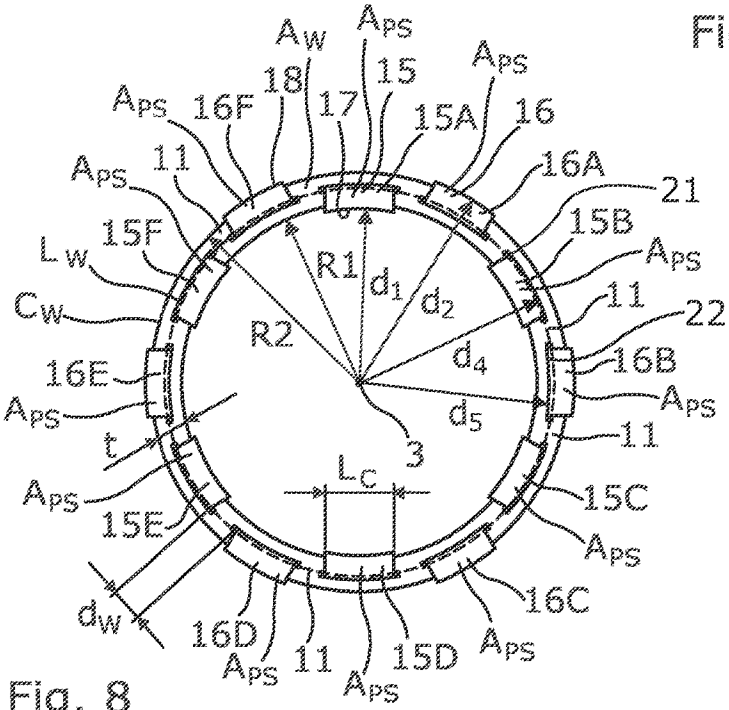

The invention and its many advantages will be described in more detail below with reference to the accompanying schematic drawings, which for the purpose of illustration show some non-limiting embodiments and in which:

FIG. 1 shows a side view of a downhole wireline tool string for removing material in a component in the well, such as a plug or a valve, FIG. 2 shows a side view of another downhole wireline tool string, FIG. 3 shows a cross-sectional view of an operational tool of another downhole wireline tool string having a fastening element for fasting part of the component to be removed, FIG. 4 shows a cross-sectional view of another operational tool having another fastening element, FIG. 5 shows another operational tool in perspective having overlapping grinding sections along the centre wall axis, FIG. 6 shows yet another operational tool in perspective, where the first and second grinding sections form a monolithic whole, FIG. 7 shows another operational tool in perspective having grinding sections overlapping the centre wall axis, FIG. 8 shows a view of the front end towards the top end of yet another operational tool having first and second grinding sections, FIG. 9 shows a cross-sectional view of yet another operational tool, FIG. 10 shows a front view of the operational tool of FIG. 8, the hatched area illustrating the annular grinding area, and FIG. 11 shows a cross-sectional view of a component to be removed from the well for illustrating the annular grinding area forming part of the volume to be removed.

All the figures are highly schematic and not necessarily to scale, and they show only those parts which are necessary in order to elucidate the invention, other parts being omitted or merely suggested.

FIG. 1 shows a downhole wireline tool string 1 for removing material of a component in a well 2 downhole by an annular grinding area $A_R$. The downhole wireline tool string 1 has an axial extension E, a centre tool axis 3, a front end 4 and a top end 5 connectable to a wireline 6. The downhole wireline tool string 1 comprises an electric motor 7 powered through the wireline for providing rotational output for rotating an operational tool 10 defining the front end and an end surface 11 arranged axially opposite the wireline. The operational tool 10 comprises an annular wall 12. The operational tool 10 comprises at least a first grinding section 15 and a second grinding section 16 arranged at the end surface. The downhole wireline tool string 1 further comprises a tool section 8 for anchoring the downhole wireline tool string inside a well tubular metal structure 9.

The tool section 8 shown in FIG. 1 comprises two driving units 32, such as a downhole tractor, having projectable arms 33, each arm having a wheel 34, and the wheels contact the inner surface of the well tubular metal structure 9 for propelling the driving unit 32 and the tool string 1 forward in the casing. The downhole wireline tool string 1 is propelled forward in the well tubular metal structure 9 until the operational tool 10 has reached the component, a plug 40, to be removed. The tool section shown in FIG. 2 comprises an anchoring unit 35 having anchoring elements 36 projected from the downhole wireline tool string 1 for contacting the inner surface of the well tubular metal structure 9 for anchoring the downhole wireline tool string 1 inside the well tubular metal structure 9. In FIG. 2, the tool section 8 further comprises a stroking unit 37 for providing an axial stroke of at least the operational tool 10 along the centre tool axis 3. The downhole wireline tool string 1 is lowered via the wireline 6 in the well tubular metal structure 9 until the operational tool 10 has reached the component, a valve 41, to be removed. The downhole wireline tool string 1 further comprises a pumping unit 39 driven by the electric motor 7 for providing pressurised fluid to the driving units 32 and/or the anchoring unit 35 and the stroking unit 37. The downhole wireline tool string 1 further comprises a gear unit 31 arranged between the electric motor 7 and the operational tool 10 so that the operational tool 10 is rotated at a higher rotational speed than the rotational output of the electric motor 7.

In FIGS. 7 and 8, the annular wall 12 has a circumference $C_w$, and a wall thickness t is defined by an inner wall radius $R_1$ and an outer wall radius $R_2$ from the centre tool axis 3. The first grinding section 15 has an inner face 17 being arranged at a first distance $d_1$ from the centre tool axis 3, and the first distance $d_1$ is smaller than the inner wall radius $R_1$. The second grinding section 16 has an outer face 18 being arranged at a second distance $d_2$ from the centre tool axis 3, and the second distance $d_2$ is greater than the outer wall radius $R_2$.

When the first grinding section 15 extends further towards the centre tool axis 3 than the inner face of the wall and the second grinding section 16 extends further radially outwards than the outer face of the wall, the grinding sections are able to remove a larger area than that of the annular wall 12 and thus a sufficient area of the completion component, e.g. the plug, to be able to release the completion component, e.g. the plug.

As shown in FIGS. 5 and 8, the first and second grinding sections are so arranged that an outer face 21 of the first grinding section is arranged at a fourth distance $d_4$ from the centre tool axis, where the fourth distance is smaller than the second distance. Furthermore, an inner face 22 of the second grinding section being arranged at a fifth distance $d_5$ from the centre tool axis, where the fifth distance is larger than the first distance.

By having the fourth distance being smaller than the second distance and/or the fifth distance being larger than the first distance, the contact area between the grinding sections and the material to be grinded and removed is reduced and the friction generated during rotation is thus correspondingly reduced and the power required to provide the rotation is likewise reduced. When performing a machining operation on wireline, the power available in the tool several kilometres down the well is substantially reduced compared to drill pipe and coiled tubing operations, and therefore such reduction makes it possible to increase the grinding area and thus remove a larger area on a component. When using drill pipe or coiled tubing, power is not limited due to the distance from the surface to the position several kilometres down the well where the material is to be removed as fluid pressure down the pipe/tubing is not substantially reduced, but when using wireline, the power is substantially reduced due to the resistance of the wireline, such from 1200 V to 600 V.

The first grinding section 15 and the second grinding section 16 are separate elements in FIGS. 3-5 and 8-9, and in FIG. 6 the first and second grinding sections form a monolithic whole, i.e. one grinding element. When viewing the operational tool 10 from the front end towards the top end, the first and the second grinding sections have a projected grinding section area $A_{PS}$ perpendicular to the axial extension E. The projected grinding section area $A_{PS}$ is thus the common surface area of all the first and second grinding sections in total. Common for all aspects of the operational tool 10 is that the projected grinding section area $A_{PS}$ is smaller than the cross-sectional area $A_w$ of the annular wall at the end surface perpendicular to the centre tool axis 3.

By having the projected grinding section area $A_{PS}$ smaller than the cross-sectional area $A_w$ of the annular wall 12 at the end surface perpendicular to the centre tool axis 3, a wireline-powered tool string is able to machine the part of the plug or valve in a sufficient area at only 1-3 kW. In that way, the area contacting and machining/grinding the valve or plug is substantially reduced compared to a grinding bit having the full cross-sectional area $A_w$ of the annular wall 12, and the electric motor 7 is then capable of rotating the operational tool 10.

In FIGS. 5, 7 and 8, the operational tool 10 comprises a plurality of first grinding sections 15, 15A, 15B, 15C, 15D, 15E, 15F and a plurality of second grinding sections 16, 16A, 16B, 16C, 16D, 16E, 16F. The first and second grinding sections are arranged in turns, i.e., a first grinding section is arranged next to a first second grinding section, which is arranged next to a second first grinding section.

In FIGS. 7 and 8, the first grinding section is arranged at a third distance $d_3$ from the second grinding section along the circumference $C_w$ of the annular wall 12. The grinding sections have a circumferential length Lc, and the third distance is smaller than the circumferential length, preferably the distance is 20% smaller than the circumferential length, and more preferably the distance is 40% smaller than the circumferential length.

In FIG. 6, the first and second grinding sections form a monolithic whole, i.e. one grinding element, and the first and second grinding sections are fictitiously separated by the imaginary separation lines SL as illustrated in FIG. 6 by a dotted line. The grinding element is formed by rounded grooves where the rounded grooves on the inner face have a smaller radius than the rounded grooves on the outer face. In this way, the projected grinding section area $A_{PS}$ has been reduced compared to a full area without the rounded grooves.

The annular grinding area $A_R$ to be removed is defined as the annular grinding area between the first distance $d_1$ and the second distance $d_2$ when rotating the operational tool 10 in one turn around the centre tool axis 3, as shown in FIG. 10 with dotted lines and cross-sectional hatching. As can be seen, the annular grinding area $A_R$ is greater than the cross-sectional area $A_w$ of the annular wall 12 at the end surface. In FIG. 11, a plug 40 is shown in a cross-sectional view, and the volume VR to be removed in order for the dogs of the plug to release from engaging the wall of the well tubular metal structure 9 is illustrated by dotted lines. The annular grinding area $A_R$ is also illustrated by an arrow pointing at the end of the volume VR to be removed.

As can be seen in FIG. 10, the projected grinding section area $A_{PS}$ (shown in FIG. 8) being the area of each grinding section is smaller than the annular grinding area $A_R$, preferably 10% smaller than the annular grinding area $A_R$, more preferably 25% smaller than the annular grinding area $A_R$, and in FIG. 10 approximately 50% smaller than the annular grinding area $A_R$. The inner wall radius $R_1$ is at least 3 times larger than a radial thickness of the annular grinding area $A_R$, and preferably 5 times larger than a radial thickness of the annular grinding area $A_R$. The projected grinding section area $A_{PS}$ (shown in FIG. 8) being the total common area of the area of each grinding section, i.e. six times the end area of the first grinding section and six times the end area of the second grinding section. In FIG. 8, the projected grinding section area $A_{PS}$ is less than 50% of the annular grinding area $A_R$, shown in FIG. 10.

By having the projected grinding section area $A_{PS}$ smaller than 25-50% of the annular grinding area $A_R$, at the end surface perpendicular to the centre tool axis 3, a wireline-powered tool string is able to machine the part of the plug or valve in a sufficient area at only 1-3 kW. In that way, the area contacting and machining/grinding the valve or plug is substantially reduced compared to a grinding bit having the full cross-sectional area $A_w$ of the annular wall 12 run on e.g. drill pipe or coiled tubing, and the electric motor 7 is then capable of rotating the operational tool 10 on only 1-3 kW.

In FIG. 8, the wall thickness has a centre wall axis $L_w$ when seen in cross-section perpendicular to the axial extension, and the first grinding section and the second grinding section are overlapping the centre wall axis.

In FIG. 5, the wall thickness has the centre wall axis $L_w$ when seen in cross-section perpendicular to the axial extension, and the first grinding sections and the second grinding sections are overlapping along the centre wall axis and thus along the circumference of the annular wall 12.

The grinding section(s) is/are welded to the annular wall 12 and arranged in grooves in the annular wall. The grinding section(s) is/are thus an insert(s) and may be embedded particles of tungsten carbide, cubic boron nitride (CBN) and/or diamonds, where which particles are embedded in a binder material. In this manner, the grinding sections/inserts may be worn while still being able to machine as new particles will appear, which particles are configured to proceed with the machining.

When the first grinding section extends further towards the centre tool axis 3 than the inner face of the wall, the first and second grinding sections are able to remove a larger area than that of the annular wall 12 and thus a sufficient area of the completion component to make room for a fastening element 43 within the annular wall for fastening a released/cut-out part of a valve, as shown in FIGS. 3 and 4. The fastening element 43 is arranged within the annular wall 12 of the operational tool 10 so that the annular wall 12 is rotatable around the fastening element 43. The wall thickness of the annular wall 12 is defined by the inner wall radius $R_1$ and an outer wall radius $R_2$ from the centre tool axis 3 at the front end, and closer to the top end an inner wall radius $R_3$ is longer than the inner wall radius $R_1$ at the front end, creating an annular groove 24 in which the fastening element 43 is arranged. In FIG. 3, the fastening element 43 is a tubular element 25 with elongated groves 46 extending from the end closest to the front end, creating elongated springy arms. The arms 47 bend towards the groove 24 when the part of the valve being released enters as the grinding sections machine further into the valve.

In FIG. 4, the fastening element 43 comprises a plurality of base parts 44 and projecting parts 45, and each projecting part 45 is more flexible than the base part 44. The fastening element 43 further comprises a distance part 48 in between the plurality of base parts. The fastening element 43 is arranged in an annular groove 24 created by the greater inner wall radius $R_3$.

Even though not shown, the operational tool may have a drill bit having a centre axis coincident with the centre tool axis. The drill bit functions as centre bit or a pilot bit.

A stroking unit is a tool providing an axial force. The stroking unit comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil, and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, the downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole wireline tool string for removing material of a component in a well downhole by an annular grinding area, the downhole wireline tool string having an axial extension and a centre tool axis, a front end and a top end connectable to a wireline, comprising:

an electric motor powered through the wireline for providing rotational output, a tool section for anchoring the downhole wireline tool string inside a well tubular metal structure, an operational tool rotated by the rotational output and defining the front end and an end surface arranged axially opposite the wireline and comprising an annular wall having a circumference and a wall thickness defined by an inner wall radius and an outer wall radius from the centre tool axis, wherein the operational tool comprises at least a first grinding section and a second grinding section arranged at the end surface, the first grinding section having an inner face being arranged at a first distance from the centre tool axis, the first distance being smaller than the inner wall radius, and the second grinding section having an outer face being arranged at a second distance from the centre tool axis, the second distance being greater than the outer wall radius, and wherein an outer face of the first grinding section being arranged at a fourth distance from the centre tool axis, where the fourth distance is smaller than the second distance, and wherein at least one of the first grinding section and the second grinding section extends along an entire circumference of the annular wall.

2. A downhole wireline tool string according to claim 1, wherein an inner face of second grinding section being arranged at a fifth distance from the centre tool axis, where the fifth distance is larger than the first distance.

3. A downhole wireline tool string according to claim 1, wherein the first grinding section and the second grinding section are separate elements.

4. A downhole wireline tool string according to claim 3, wherein the operational tool comprises a plurality of first grinding sections and a plurality of second grinding sections, the first and second grinding sections being arranged in turns, so that a first grinding section is arranged next to a first second grinding section, which is arranged next to a second first grinding section.

5. A downhole wireline tool string according to claim 4, wherein the first grinding section is arranged at a third distance from the second grinding section along the circumference of the annular wall, the grinding sections having a circumferential length, and the third distance being smaller than the circumferential length.

6. A downhole wireline tool string according to claim 4, wherein the inner wall radius is at least 3 times larger than a radial thickness of the annular grinding area.

7. A downhole wireline tool string according to claim 1, wherein the annular grinding area is defined as the area between the first distance and the second distance when rotating the operational tool in one turn around the centre tool axis, the annular grinding area being greater than the cross-sectional area of the annular wall at the end surface.

8. A downhole wireline tool string according to claim 1, wherein when viewing the front end towards the top end, the first and the second grinding sections have a projected grinding section area perpendicular to the axial extension.

9. A downhole wireline tool string according to claim 8, wherein the projected grinding section area is smaller than the cross-sectional area of the annular wall at the end surface perpendicular to the centre tool axis.

10. A downhole wireline tool string according to claim 1, wherein the first and second grinding sections form a monolithic whole.

11. A downhole wireline tool string according to claim 1, wherein the wall thickness has a centre wall axis when seen in cross-section perpendicular to the axial extension, the first grinding section and the second grinding section overlapping the centre wall axis.

12. A downhole wireline tool string according to claim 1, wherein the wall thickness has a centre wall axis when seen in cross-section perpendicular to the axial extension, the first grinding section and the second grinding section overlapping along the centre wall axis.

13. A downhole wireline tool string according to claim 1, wherein the operational tool further comprises a fastening element, the annular wall being rotatable around the fastening element.

14. A downhole wireline tool string according to claim 13, wherein the fastening element comprises a base part and a projecting part, the projecting part being more flexible than the base part.

15. A downhole wireline tool string according to claim 1, wherein the first and second grinding sections together extend along the entire circumference of the annular wall.

* * * * *